US010060618B2

(12) United States Patent
Juan

(10) Patent No.: US 10,060,618 B2
(45) Date of Patent: Aug. 28, 2018

(54) PRESSURE-GAIN COMBUSTION APPARATUS AND METHOD

(71) Applicant: EXPONENTIAL TECHNOLOGIES, INC., Calgary (CA)

(72) Inventor: Alejandro Juan, Calgary (CA)

(73) Assignee: EXPONENTIAL TECHNOLOGIES, INC., Calgary, Alberta (CA)

( * ) Notice: Subject to any disclaimer, the term of this patent is extended or adjusted under 35 U.S.C. 154(b) by 348 days.

(21) Appl. No.: 14/441,098

(22) PCT Filed: Nov. 7, 2013

(86) PCT No.: PCT/CA2013/050856

§ 371 (c)(1),
(2) Date: May 6, 2015

(87) PCT Pub. No.: WO2014/071525

PCT Pub. Date: May 15, 2014

(65) Prior Publication Data

US 2015/0300630 A1 Oct. 22, 2015

Related U.S. Application Data

(60) Provisional application No. 61/723,667, filed on Nov. 7, 2012.

(51) Int. Cl.
*F23D 14/82* (2006.01)
*F23C 3/00* (2006.01)
(Continued)

(52) U.S. Cl.
CPC ..... *F23C 3/006* (2013.01); *F23C 3/00* (2013.01); *F23C 15/00* (2013.01); *F23R 7/00* (2013.01)

(58) Field of Classification Search
CPC ..... F23C 7/004; F23C 15/00; F23C 2205/00; F23R 2900/03045; F23R 7/00; F23D 2209/10; F23D 14/82; F02K 7/02
See application file for complete search history.

(56) References Cited

U.S. PATENT DOCUMENTS 3,736,747 A * 6/1973 Warren ..... F23R 3/002 60/730
4,632,745 A 12/1986 Giuffrida et al.
(Continued)

FOREIGN PATENT DOCUMENTS

WO 2010031173 A1 3/2010
WO 2012145836 A1 11/2012
WO WO2012145836 A1 11/2012

OTHER PUBLICATIONS

International Search Report and Written Opinion for PCT/CA2013/050856 dated Jan. 24, 2014.
(Continued)

*Primary Examiner* — Jason Lau
(74) *Attorney, Agent, or Firm* — Jiarong L. Lamiquiz; Quarles & Brady LLP

(57) ABSTRACT

A pressure gain combustor comprises a detonation chamber, a pre-combustion chamber, an oxidant swirl generator, an expansion-deflection (E-D) nozzle, and an ignition source. The detonation chamber has an upstream intake end and a downstream discharge end, and is configured to allow a supersonic combustion event to propagate therethrough. The pre-combustion chamber has a downstream end in fluid communication with the detonation chamber intake end, an upstream end in communication with a fuel delivery pathway, and a circumferential perimeter between the upstream and downstream ends with an annular opening in communication with an annular oxidant delivery pathway. The oxidant swirl generator is located in the oxidant delivery pathway and comprises vanes configured to cause oxidant flowing past the vanes to flow tangentially into the pre-combustion chamber thereby creating a high swirl velocity zone around the annular opening and a low swirl velocity zone in a central portion of the pre-combustion chamber. The E-D nozzle is positioned in between the pre-combustion
(Continued)

chamber and detonation chamber and provides a diffusive fluid pathway therebetween. The ignition source is in communication with the low swirl velocity zone of the pre-combustion chamber. This configuration is expected to provide a combustor with a relatively low total run-up DDT distance and time, thereby enabling high operating frequencies and corresponding high combustor performance.

21 Claims, 14 Drawing Sheets

(51) Int. Cl.
*F23C 15/00* (2006.01)
*F23R 7/00* (2006.01)

(56) References Cited

U.S. PATENT DOCUMENTS 5,755,196 A 5/1998 Klassen
6,036,463 A 3/2000 Klassen
6,497,564 B2 12/2002 Klassen
6,505,462 B2 1/2003 Meholic
6,705,161 B1 3/2004 Klassen
6,739,852 B1 5/2004 Klassen
7,326,325 B2 2/2008 Liang et al.
7,621,118 B2 11/2009 Snyder et al.
7,758,334 B2 7/2010 Shimo et al.
7,828,546 B2 11/2010 Wiedenhoefer et al.
2007/0180810 A1* 8/2007 Chapin ..... F01D 25/12 60/39.76
2009/0133377 A1 5/2009 Kenyon et al.
2010/0050592 A1 3/2010 Lu et al.
2011/0016869 A1* 1/2011 Iwasaki ..... F23R 3/002 60/752
2011/0302904 A1 12/2011 Zhang et al.

OTHER PUBLICATIONS

"Pulse Detonation Engine": https://en.wikipedia.org/wiki/Pulse_detonation_engine (accessed May 12, 2011).
Extended European Search Report in related European Application No. 13852595.1, dated Jul. 6, 2016, 6 pages.

* cited by examiner

PRESSURE-GAIN COMBUSTION APPARATUS AND METHOD

FIELD

The invention described relates generally to pressure gain combustion and in particular to a pressure gain combustion apparatus such as a pulse detonation engine and a method for operating same.

BACKGROUND

Pressure-gain combustion increases pressure across a combustion chamber thereby thermodynamically approximating a constant volume process, resulting in higher efficiency engines than conventional constant-pressure combustion engines. One method to achieve pressure-gain combustion is with an oscillatory combustion apparatus such as pulse jets or a pulse detonation engine (otherwise known as "pulse detonation combustor") that carry out pulse detonation combustion.

Pulse detonation combustion is a type of pressure gain combustion process wherein an engine is pulsed to allow a combustible mixture in the combustion chamber to be purged and renewed in between detonations triggered by an ignition source. The detonation is a supersonic combustion event wherein a flame front becomes coupled to a shock wave and propagates through a reactive mixture at sonic velocities. As a consequence, its thermodynamic behaviour effectively approaches that of a constant-volume combustion process which provides higher pressure, higher thermal efficiency and lower specific fuel consumption compared with constant-pressure or steady deflagration processes. Pulse detonation combustors are potentially thermodynamically more efficient because they rely on a pressure rise from a supersonic, shock-induced combustion wave, rather than the constant pressure deflagration process in a standard constant-pressure combustor. The flame speed in a pulse detonation can travel at 6000 fps., compared to 20-70 fps in a conventional constant pressure combustor.

The operational cycle of a single detonation cycle is comprised of filling a detonation tube with a combustible mixture of fuel and oxidant, igniting the mixture, propagating a detonation wave towards the discharge end of the tube, and expelling the combustion products. In an open ended combustion tube, the products are expelled from the tube by rarefaction waves created by a sudden expansion to atmospheric pressure as the detonation wave exits the open end. The cycle can be repeated several times a second.

Rapid transitioning to detonation is desirable to achieve high operating frequencies resulting in higher power output. The deflagration-to-detonation transition (DDT) is where a subsonic deflagration, created using low energy initiation, transitions to a supersonic detonation. The process can be broken down into four phases: (i) mixture ignition, (ii) combustion wave acceleration, (iii) formation of explosion centres, and (iv) development of the detonation front. The distance and time necessary for transition to detonation is called the run-up distance and time, respectively. Stages (i) to (iii) take up the majority of the total run-up DDT distance and time. The majority of the time for DDT is consumed largely by the laminar to turbulent flame transition. The distance for DDT is more sensitive to the acceleration of the turbulent flame. Obstacles along the flow path such as Shchelkin spirals are known to decrease DDT by shortening the distance and time for stages (ii) and (iii). It is thus desirable to provide a pulse detonation combustor which achieves high operating frequencies for better efficiency and performance. Particularly, it is desirable to provide a pulse detonation combustor which has a reduced total run-up DDT distance and time, thereby enabling high operating frequencies and corresponding improved combustor performance and higher power density.

Another challenge to efficient and effective operation of pulse detonation combustors is controlling combustion product backflow and backpressure caused by detonation shockwaves. One known approach to preventing backflow is to use a mechanical valving system. In pulse detonation combustors with such valving systems, a mechanical valve opens to fill a detonation chamber with a combustible mixture and closes thereafter during the detonation initiation and propagation stages as well as the blowdown stages. Exemplary valving mechanisms are described in U.S. Pat. No. 7,621,118 and U.S. Pat. No. 6,505,462. These valving mechanism impose mechanical complexity and tend to be prone to mechanical and thermal fatigue issues that lead to limited service life and additional service maintenance requirements. The operational frequency of the apparatus can also be limited by a mechanical valving system.

SUMMARY

According to one aspect of the invention there is provided a pressure gain combustor comprising a detonation chamber, a pre-combustion chamber, an oxidant swirl generator, an expansion-deflection (E-D) nozzle, and an ignition source. The detonation chamber has an upstream intake end and a downstream discharge end, and is configured to allow a supersonic combustion event to propagate therethrough. The pre-combustion chamber has a downstream end in fluid communication with the detonation chamber intake end, an upstream end in communication with a fuel delivery pathway, and a circumferential perimeter between the upstream and downstream ends with an annular opening in communication with an annular oxidant delivery pathway. The oxidant swirl generator is located in the oxidant delivery pathway and comprises vanes configured to cause oxidant flowing past the vanes to flow tangentially and turbulently into the pre-combustion chamber thereby creating a high swirl velocity zone around the annular opening and a low swirl velocity zone in a central portion of the pre-combustion chamber. The E-D nozzle is positioned in between the pre-combustion chamber and detonation chamber and provides a diffusive fluid pathway therebetween. The ignition source is in communication with the low swirl velocity zone of the pre-combustion chamber, and can be selected from a group consisting of an electrical spark discharge source, a plasma pulse source, and a laser pulse source. This configuration is expected to provide a combustor with a relatively low total run-up DDT distance and time, thereby enabling high operating frequencies and corresponding high combustor performance.

The E-D nozzle can comprise a generally cylindrical body with an internal bore having a downstream end in fluid communication with the detonation chamber, and at least one circumferentially disposed port in the body that is in fluid communication with the bore; an annular rim extending outwards from the body and which contacts an outer rim of the detonation chamber's intake end; a generally cylindrical cowling that extends from the annular rim past an upstream end of the cylindrical body such that an annular space is defined between the cowl and the cylindrical body; and an end plate at the upstream end of the bore and having at least one diffuser channel extending through the plate and providing fluid communication between the bore and the pre-combustion chamber. The diffuser channel and port provide the diffusive pathway between the pre-combustion chamber and the detonation chamber. The cowling can have a mantle with a partial toroidal form and which extends into the pre-combustion chamber and into sufficient proximity with the annular opening thereof to create a Coanda effect which deflects tangentially flowing oxidant radially inwards towards the center of the pre-combustion chamber. The end plate can comprise a plurality of diffuser channels, each of which extend at an angle outwardly from the bore such that each channel is directed toward an inside surface of the cowling and not the pre-combustion chamber.

According to another aspect of the invention, there is provided a method for operating a pressure gain combustor comprising: tangentially and turbulently flowing an oxidant into a pre-combustion chamber to form a high swirl velocity zone at an outer portion of the pre-combustion chamber and a low swirl velocity zone at an inner portion of the pre-combustion chamber; injecting fuel into the high swirl velocity zone of the pre-combustion chamber; flowing a mixture of the fuel and oxidant into a detonation chamber in fluid communication with the pre-combustion chamber; igniting the fuel and oxidant in a low velocity swirl zone of the pre-combustion chamber to form a flame kernel after a selected dwell period; and directing a flame front formed from the flame kernel though an E-D nozzle into the detonation chamber such that oxidant and fuel in the detonation chamber is detonated, causing a supersonic combustion event wherein the flame front becomes coupled to a shock wave and propagates through the detonation chamber at sonic velocities. Operating the combustor in such a manner is expected to provide for a relatively low total run-up DDT distance and time, thereby enabling high operating frequencies and corresponding high combustor performance.

According to yet another aspect of the invention, there is provided a pressure gain combustor comprising: a detonation chamber having an upstream intake end and a downstream discharge end, wherein the detonation chamber is configured to allow a supersonic combustion event to propagate therethrough; a pre-combustion chamber in fluid communication with the detonation chamber intake end and in fluid communication with a fuel delivery pathway and an oxidant delivery pathway; an ignition source in communication with the pre-combustion chamber and positioned to ignite a fuel/oxidizer mixture therein; an E-D nozzle in between the pre-combustion chamber and detonation chamber and comprising a diffusive fluid pathway configured to be less restrictive to fluid flow in a downstream direction than in an upstream direction. This configuration is expected to effectively control combustion product backflow and backpressure caused by detonation shockwaves inside the combustor.

The E-D nozzle can be configured in the manner described above. With this E-D nozzle, upstream fluid flow is more restrictive than the downstream fluid flow due to the cowling directing at least a portion of upstream fluid flow from the channels into the annular space thereby interfering with upstream fluid flow that flows into the annular space via the port.

According to another aspect of the invention, there is provided a pressure gain combustor comprising: a detonation chamber having an upstream intake end and a downstream discharge end, wherein the detonation chamber is configured to allow a supersonic combustion event to propagate therethrough; a pre-combustion chamber in fluid communication with the detonation chamber intake end and in fluid communication with a fuel delivery pathway and an oxidant delivery pathway; an ignition source in communication with the pre-combustion chamber and positioned to ignite a fuel/oxidizer mixture therein; an E-D nozzle in between the pre-combustion chamber and detonation chamber and comprising a diffusive fluid pathway therebetween; and an expansion chamber in fluid communication with an oxidant inlet and the pre-combustion chamber, and comprising a volume selected to reduce a backpressure caused by detonation in the detonation chamber to a desired static pressure inside the expansion chamber. The desired static pressure can be a pressure that is less than an oxidant pressure at the oxidant inlet. This configuration is expected to effectively control combustion product backflow and backpressure caused by detonation shockwaves.

The expansion chamber can comprise a preheat chamber in thermal communication with the detonation chamber and be in fluid communication with the pre-combustion chamber, and a plenum chamber that is in fluid communication with the preheat chamber and with the oxidant inlet. A deflector shell can have a frusto-conical shape and be positioned inside the plenum chamber to form a sinuous oxidant flow pathway therein.

According to yet another aspect of the invention there is provided a pressure gain combustor comprising: a detonation chamber having an upstream intake end and a downstream discharge end, wherein the detonation chamber is configured to allow a supersonic combustion event to propagate therethrough; a fuel-oxidant mixing chamber in fluid communication with the detonation chamber intake end and in fluid communication with a fuel delivery pathway and an oxidant delivery pathway; an ignition source in communication with the detonation chamber and positioned to ignite a fuel/oxidizer mixture therein; a diffuser in between the mixing chamber and detonation chamber and comprising a diffusive fluid pathway for diffusing a downstream flow fluid from the mixing chamber to the detonation chamber; and an aerodynamic valve subassembly in the oxidant delivery pathway comprising at least one annular ring segment having a bore tapering radially inwards to form a frusto-conical nozzle facing a downstream direction, thereby defining an oxidant delivery pathway configured that is less restrictive in the downstream direction than in an upstream direction. The pressure gain combustor can further comprise at least one oxidant duct fluidly coupled to the expansion chamber and mixing chamber, in which case the aerodynamic valve subassembly is located in the duct. This configuration is expected to effectively control combustion product backflow and backpressure caused by detonation shockwaves in the combustor.

The pressure gain combustor can further comprise an expansion chamber in fluid communication with an oxidant inlet and the mixing chamber; this expansion chamber comprises a volume selected to reduce a backpressure caused by detonation in the detonation chamber to a desired static pressure inside the expansion chamber. The expansion chamber can be in thermal communication with the detonation chamber thereby serving as a pre-heat chamber to heat oxidant flowing therethrough.

DETAILED DESCRIPTION

Figure 1:
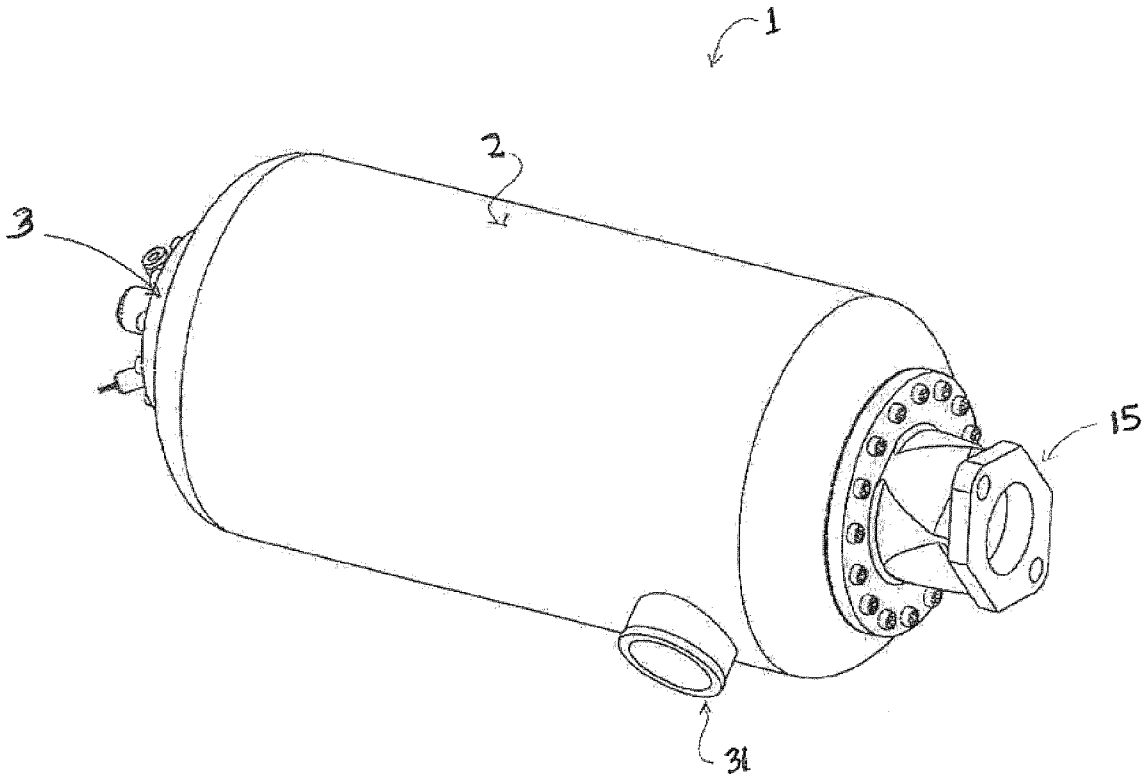
FIG. 1 is a front perspective view of a pulse detonation combustor according to a first embodiment of the invention.
Figure 2:
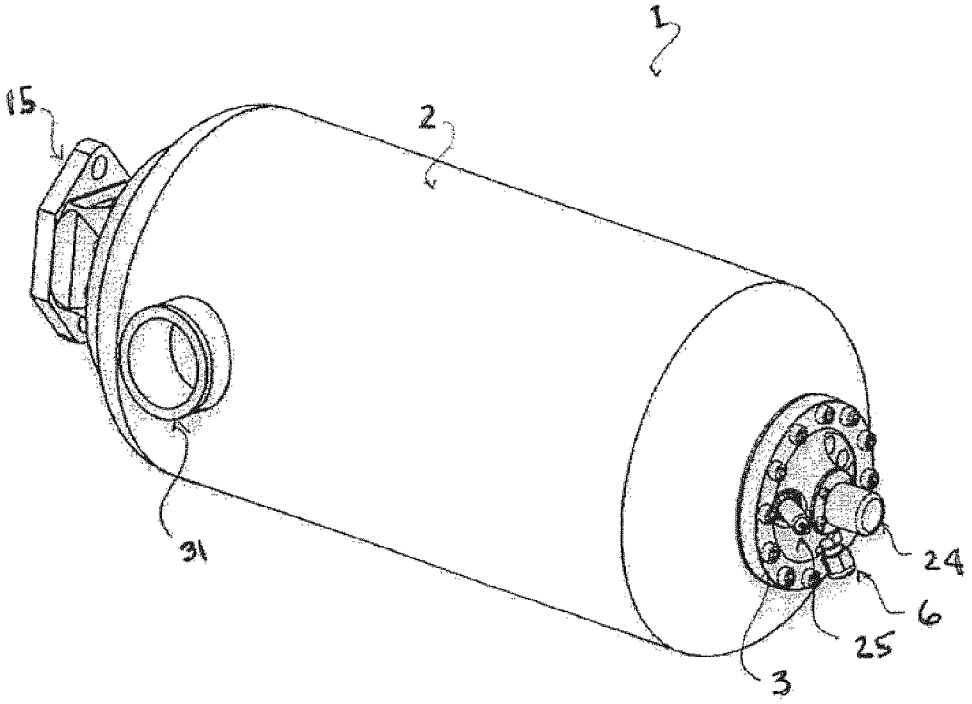
FIG. 2 is a rear perspective view of the pulse detonation combustor.

Directional terms such as "front", "back", "rear" are used in the following description for the purpose of providing relative reference only, and are not intended to suggest any limitations on how any apparatus is to be positioned during use, or to be mounted in an assembly or relative to an environment. For example, embodiments of a pulse detonation combustor are described herein to have a "back end" where a combustible mixture is ignited, and a "front end" where combustion products are discharged. Similarly, the terms "forward flow" is defined as fuel-oxidant and combustion product flow travelling from the intake port to the discharge nozzle of the combustor, "reverse flow" as flow travelling in the opposite direction, and "upstream" and "downstream" are directional terms that are relative to the flow direction through the combustor.

First Embodiment

Described herein is an embodiment of a combustion apparatus ("combustor") that is configured for pressure-gain pulse detonation to efficiently combust a fuel and oxidant (e.g. air) mixture to convert chemical energy in the fuel into useable heat energy for use in thermal applications, or kinetic energy in the form of thrust, or to produce mechanical power in conjunction with an expansion device such as a rotary positive displacement turbine. The combustor features a preheat chamber which utilizes fugitive heat from the combustion to heat incoming oxidant as it flows past the length of a detonation tube. Fugitive heat refers to heat that would otherwise be lost to conduction or convection, but which is utilized in this case to pre-heat incoming air or other oxidant. After pre-heating, the oxidant is flowed through a swirl generator (swirler) configured to generate turbulent tangential oxidant flow into a pre-combustion chamber (quarl). The quarl and swirler create a high velocity swirl zone which enhances the mixing of fuel and oxidant, thereby enhancing local combustion intensity. An ignition source is disposed in the quarl in a region having relatively low swirl velocities to allow a small flame kernel to grow.

The quarl provides a means of initially creating a highly turbulent flame which is allowed to expand into a detonation chamber via abrupt expansion or passage through a restriction like an expansion-deflection (E-D) nozzle. This pre-combustion chamber creates a turbulent flame quickly, which can substantially reduce the time required for DDT compared to combustors using spark plug ignition, thereby enabling higher frequency operation and corresponding improved combustor performance. Furthermore, the combustor is provided with stationary backpressure and backflow suppression means to impede or prevent combustion product backflow and backpressure through the combustor; in particular, the E-D nozzle can be configured to impede backflow and backpressure, and the pre-heat chamber alone or in combination with an oxidant plenum chamber can be designed to serve as an expansion chamber which reduces backpressure to below an oxidant supply pressure.

Referring now to FIGS. 1 to 10 and according to a first embodiment, a pulse detonation combustor 1 (otherwise known as a pressure gain combustor) comprises a generally cylindrical outer shell 2, an end cap 3 attached to a back end of the combustor 1, and a discharge nozzle 15 located distal to end cap 3 and attached to a front end of the combustor 1. The nozzle 15 in this embodiment is configured to connect to a rotary positive displacement device (not shown) such as that disclosed in the Applicant's PCT application WO 2010/031173; alternatively but not shown, the discharge front end of the combustor 1 can be configured to produce thrust by replacing the nozzle 15 with a thrust optimizing nozzle (not shown). An oxidant such as air, either at ambient or positive pressure is introduced into the combustor 1 via intake port 31 extending through the combustor outer shell 2. The oxidant is supplied under pressure by a compressor (not shown).

Figure 3:
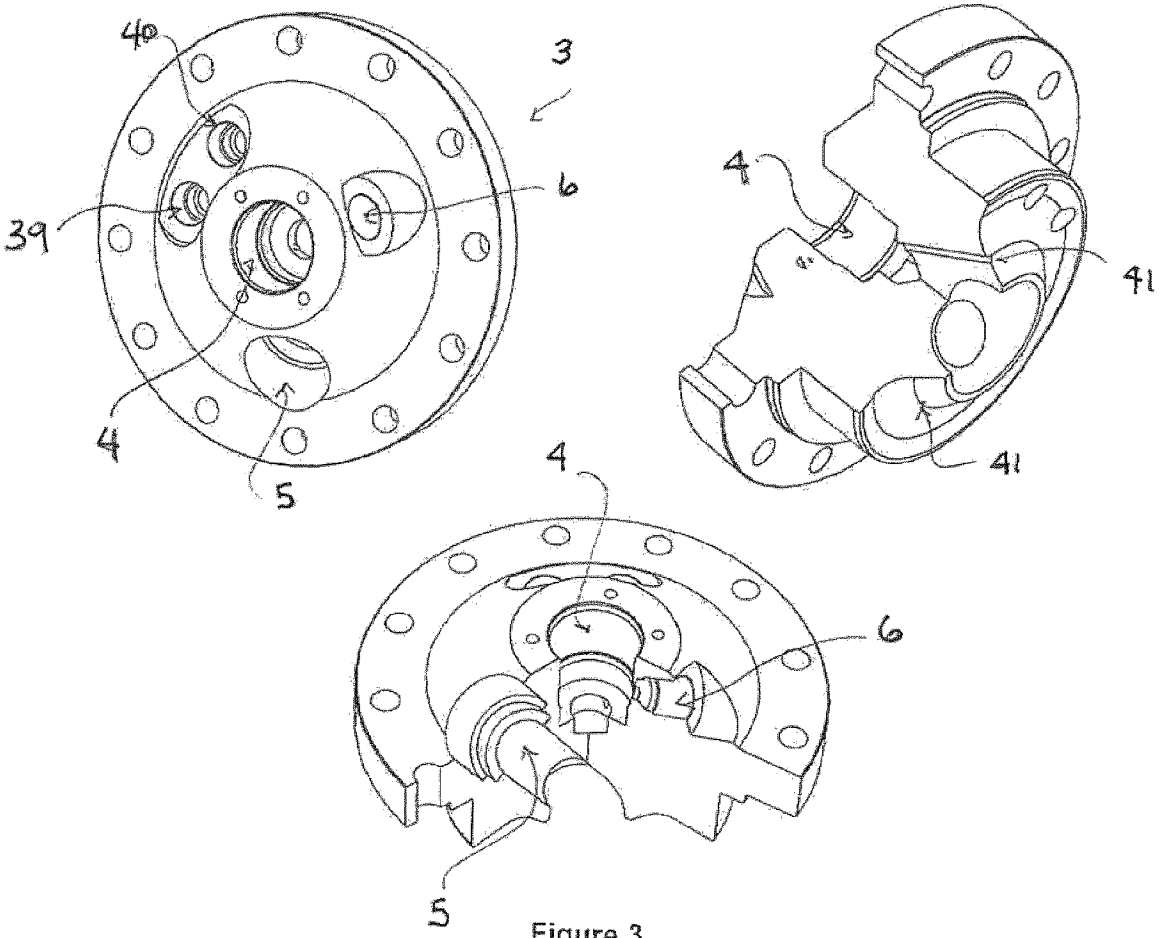
FIGS. 3(*a*) to 3(*c*) are perspective elevation, front and top sectioned views of an endcap subassembly of the combustor.

The end cap 3 is shown in more detail in FIGS. 3(*a*) to (*c*) and comprises an injection port 4 extending through the end cap 3 and in which is mounted a fuel injector 24 (see FIG. 4) that injects fuel into a pre-combustion chamber 13, herein defined as the "quarl", located inside the combustor 1. The end cap 3 also comprises an ignition port 5 extending through the end cap 3 and in which is mounted an ignition source 25 (see FIG. 4) for igniting a combustible fuel-oxidant mixture in the quarl 13. The ignition source 25 is designed to provide sufficient intensity to ignite the fuel-oxidant mixture in the quarl 13 and may generate an electrical spark, plasma pulse or a focused high intensity laser beam. A fuel port 6 supplies the injection port 4 with gaseous or liquid fuel which is cyclically introduced into the quarl 13 by the fuel injector 24. Sensor ports 39 and 40 are provided for pressure and temperature monitoring sensors (not shown) used by a combustor control system (not shown). The fuel, normally at a positive pressure, is introduced into the quarl 13 by a fuel delivery pathway comprised of multiple cylindrical passages 41 between 1 mm to 2 mm in diameter and having fluid communication with the injector port 4. These passages are sized to cause the fuel to atomize as it is discharged into the quarl 13.

The endcap 3 is bolted to the back end of the combustor 1 at a flange 32, which itself defines a rear opening 12 into the combustor 1. A sealing element 33 made from a high temperature resistant material forms a fluid-tight seal between the endcap 3 and flange 32. The ends of the combustor 1 have an ellipsoidal shape and integral as to form with a fluid tight seal with mounting flanges 32 and 30.

Figure 4:
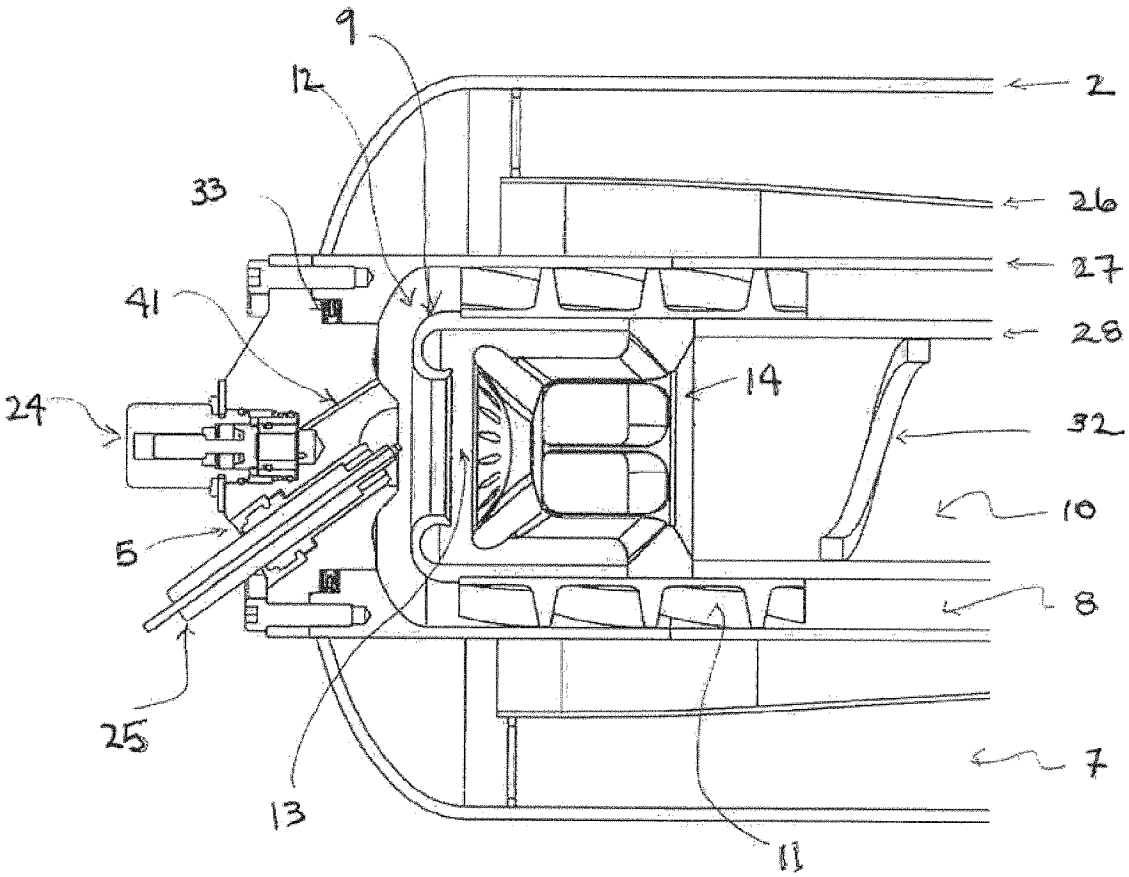
FIG. 4 is a side elevation sectioned view of a part of the pulse detonation combustor comprising a pre-combustion chamber (quarl).
Figure 5:
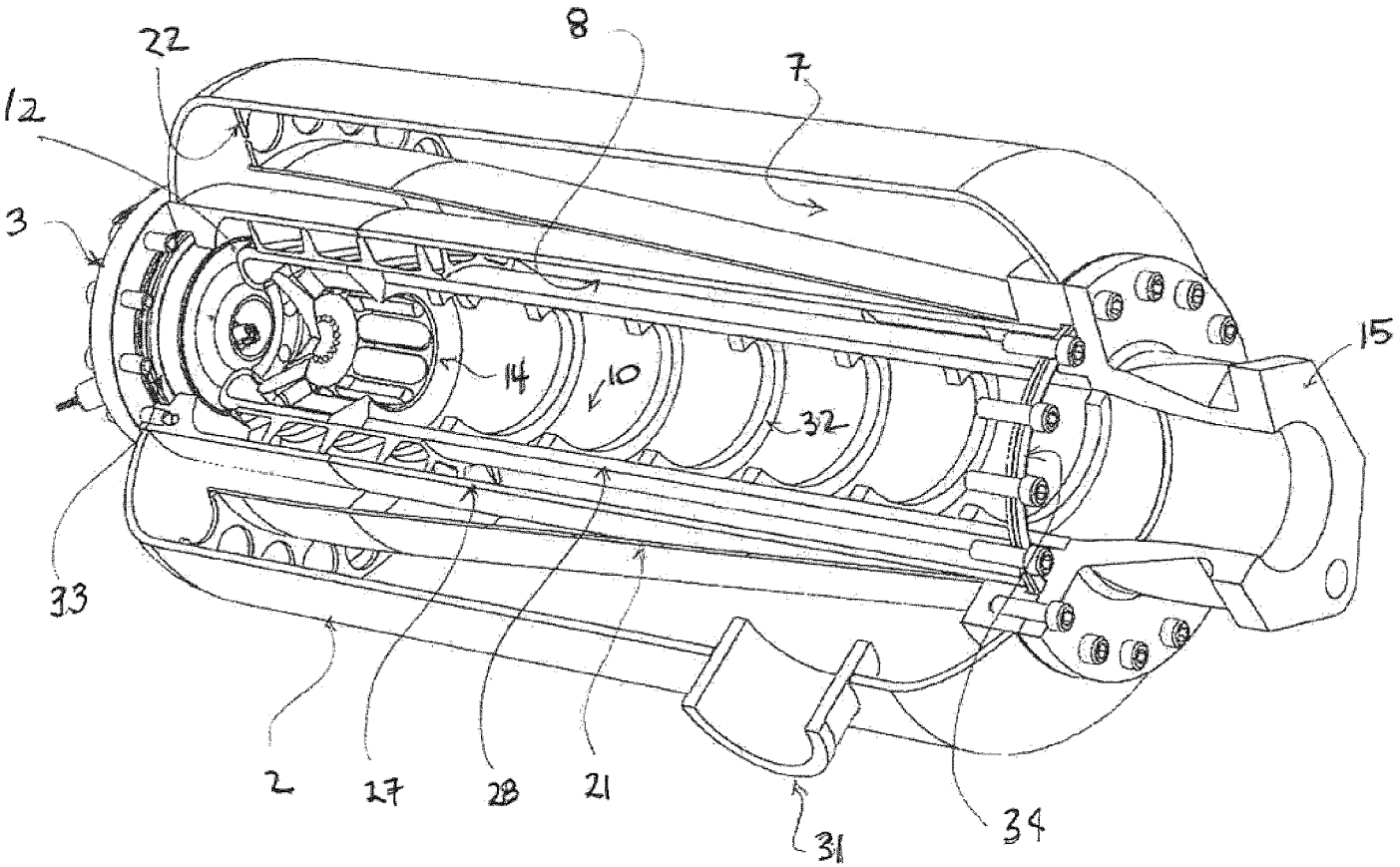
FIG. 5 is a front perspective sectioned view of the pulse detonation combustor.

Referring particularly to FIGS. 4 and 5, the inside of the combustor 1 comprises a series of generally cylindrical shells 2, 26, 27, 28 which define a series of fluidly interconnected chambers therein, namely: a generally annular oxidant plenum chamber 7 between the outer shell 2 and a preheat chamber shell 27 and in fluid communication with the intake port 31, a generally annular oxidant pre-heat chamber 8 inside the plenum chamber 7 between the pre-heat chamber shell 27 and a detonation chamber shell 28 in fluid communication with the plenum chamber 7, and a generally cylindrical detonation chamber 10 inside the pre-heat chamber 8 and detonation chamber shell 28 and in fluid communication with the pre-heat chamber 8. The quarl 13 is in fluid communication with the pre-heat chamber 8 and is located inside the pre-heat chamber shell 27 between an inside surface of the end cap 3 and the rear end of an expansion-deflection (E-D) nozzle 14. The E-D nozzle 14 is located inside of and at the back end of the detonation chamber shell 28 and as previously noted, the discharge nozzle 15 is mounted to a mounting flange 30 (see FIG. 6) located at the at front end of the combustor 1 and is in fluid communication with the detonation chamber 10. As will be discussed in detail below, the E-D nozzle 14 is configured to serve as a backflow suppression means to suppress backflow of combustion products in an upstream direction, as well as detonation backpressure in the upstream direction.

Figure 7:
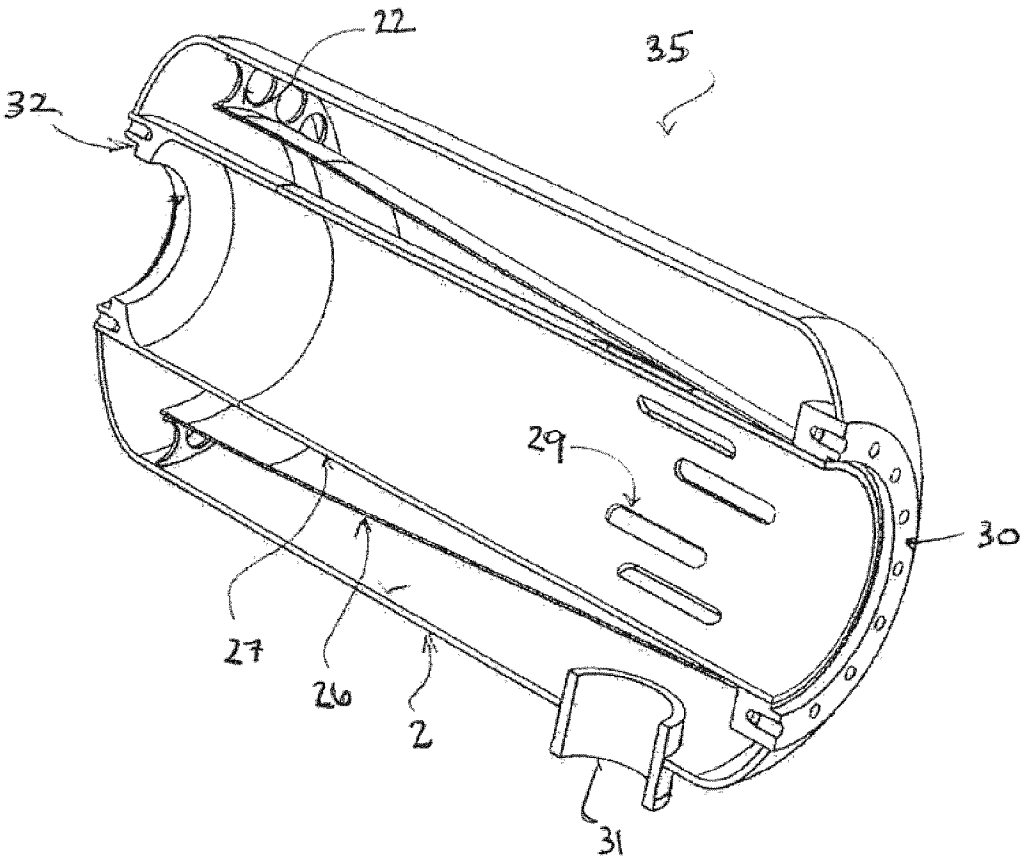
FIG. 7 is a cut-away perspective view of the plenum subassembly.

As can be seen most clearly in FIG. 7, expansion plenum and pre-heat chambers 7 and 8 are fluidly interconnected by a series of circumferentially arranged openings 29 in the annular preheat chamber shell 27. A frusto-conical deflector shell 26 is located inside the plenum chamber 7 and forms a nozzle with its widest end at the back end of the plenum chamber 7 and the narrowest end terminating directly behind the preheat chamber shell openings 29 and mechanically attached to the annular preheat chamber shell 27. The deflector shell 26 serves as a deflector to attenuate detonation pressure waves traveling in the reverse direction, that is, in the direction of flow travelling from the pre-heat chamber 8 to the plenum 7. As will be discussed in detail below, the volume of the plenum and pre-heat chambers 7,8 is selected to enable these chambers 7, 8 to serve as an expansion chamber to reduce backpressure to an acceptable level, thereby serving as a backpressure and backflow suppression means.

The plenum and pre-heat chambers 7, 8, the quarl 13 and detonation chamber 10 are fluidly connected by the following ports and openings: the intake port 31 opens into the front of the plenum chamber 7; the preheat chamber shell openings 29 located near the front end of the annular shell 27 provide fluid communication between the plenum chamber 7 and pre-heat chamber 8; an annular opening 12 formed between the annular shells 27 and 28 at the back end of the detonation chamber 10 provides fluid communication between the pre-heat chamber 8 and the quarl 13; and the E-D nozzle 14 located between the quarl 13 and the back end of the detonation chamber 10 provides fluid communication between these two chambers 10 and 13. The rear end of the detonation shell 28 is curved inwards to define a nose cowling 9 having a semi-torodial form and defining an opening into the E-D nozzle 14.

The annular shells 2, 27, 28 and the frusto-conical nozzle 26 in the combustor 1 define a continuous sinuous flow path (oxidant delivery pathway) for the oxidant to travel from the intake port 31 to the quarl 13; more particularly, the oxidant flows through the intake port 31, through the plenum chamber 7, through the pre-heat chamber 8 via the pre-heat shell openings 29, past a swirler 11 in the pre-heat chamber 8, and into the quarl 13 via the annular opening 12. The combustion pathway starts at the quarl 13, where ignition of the fuel-oxidant is initiated, and flows into the detonation chamber 10 wherein detonation occurs and then out of the front of combustor 1 wherein combustion products are discharged through the nozzle 15. The detonation chamber 10 is in thermal communication with the pre-heat chamber 8 and is configured to transfer heat from combustion through the detonation chamber shell 28 into the pre-heat chamber 8 to heat the oxidant flowing through the pre-heat chamber 8.

The plenum chamber 7 is formed by the enclosed volume between the outer shell 2 and the preheat chamber shell 27. Acting as a receiver, the plenum chamber 7 facilitates incoming oxidant fluid (e.g. air) delivered at positive pressure from a blower or compressor (not shown). In conjunction with the frusto-conical deflector shell 26, the plenum chamber 7 is also designed to absorb pressure waves from the pulsed detonations travelling in the reverse direction. The frusto-conical deflector shell 26 has its truncated portion of the cone having the smaller diameter ("front end") connected to the front end of the pre-heat chamber shell 27 such that a fluid-tight seal is established at this interconnection. The opposite rear end of the deflector shell 26 is spaced between the inside wall of the annular outer shell 2 and pre-heat chamber shell 27 and terminates just before the back end of the outer shell 2 leaving a sufficient gap for unrestricted fluid flow. The rear end of the frusto-conical shell 26 is secured in place by a perforated baffle ring 22 mounted to the inside surface of the outer shell 2; the perforations in the baffle ring 22 enable fluid flow through the baffle ring 22. As can be seen in FIG. 5, detonation pressure waves travelling in the reverse direction would follow a sinuous flow path from the detonation chamber 10 through the quarl 13, past the swirler 11 and through the preheat chamber 8 and expanding through the frustoconical shell 26 in the plenum chamber 7; these factors all contribute to cancel out or at least significantly attenuate the high intensity pressure waves that arise from the pulse detonations. In effect, the plenum chamber 7 acts as a backpressure suppression means or "shock absorber" to significantly reduce any backpressure effects on upstream components such as the blower or compressor attached to the intake port 31.

The purpose of backpressure suppression means such as the plenum chamber 7, the frusto-conical shell 26, and the sinuous flow pathway is to significantly reduce the intensity of shock waves traveling in the upstream direction. The pressure rise from detonation may not be reduced by the backpressure suppression means but they are expected to impede upstream flow to some degree. Pressure waves from detonation traveling in the upstream direction will further compress the fluid already present in upstream chambers, which is desirable. The upstream pressure waves from detonation will momentarily impede forward flow into the combustion chamber similar to the action of a mechanical valve.

The preheat chamber 8 is formed by the annular space created between the preheat chamber shell 27 and the detonation chamber shell 28; the front end of the preheat chamber 8 is capped and fluidly sealed by a flanged portion of the nozzle 15.

The plenum chamber 7 and the pre-heat chamber 8 together can be considered to be an expansion chamber that has a sufficient volume to reduce backpressure from the detonation chamber 10. More particularly, the combined volume of the plenum chamber 7 and the preheat chamber 8 is configured to be larger than the detonation chamber 10 such that the static pressure in the plenum chamber 7 is reduced by a selected degree from the detonation pressure in the detonation chamber 10. The expansion of the (backpressure) gas may be approximated as an adiabatic process since the expansion occurs over a very short period of time. The pressure and volume relationship for an adiabatic process is given by, $$P \cdot V^{\gamma} = \text{constant}$$

Therefore, the volume of the expansion chamber $V_e$ may be derived by the equation, $$P_d \cdot V_d^{\gamma} = P_e \cdot V_e^{\gamma}$$

where P and V are the pressure and volume of the chambers, respectively, and the subscripts "d" represents the detonation chamber and "e" the expansion chamber. The factor "γ" is called the adiabatic index which is a property of the gas. The detonation chamber volume and pressure values $V_d$, $P_d$ are usually dictated by combustor operation specifications, and the expansion chamber pressure $P_e$ can be dictated by certain design constraints of the expansion chamber, such as the stress limit of the expansion chamber walls. If the expansion chamber features a pressure relief valve (not shown), the expansion chamber pressure $P_e$ can be selected to be the pressure setting of the pressure relief valve.

Alternatively, one of the plenum chamber 7 and pre-heat chamber can be configured with a volume that enables that chamber alone to serve as an expansion chamber.

Figure 6:
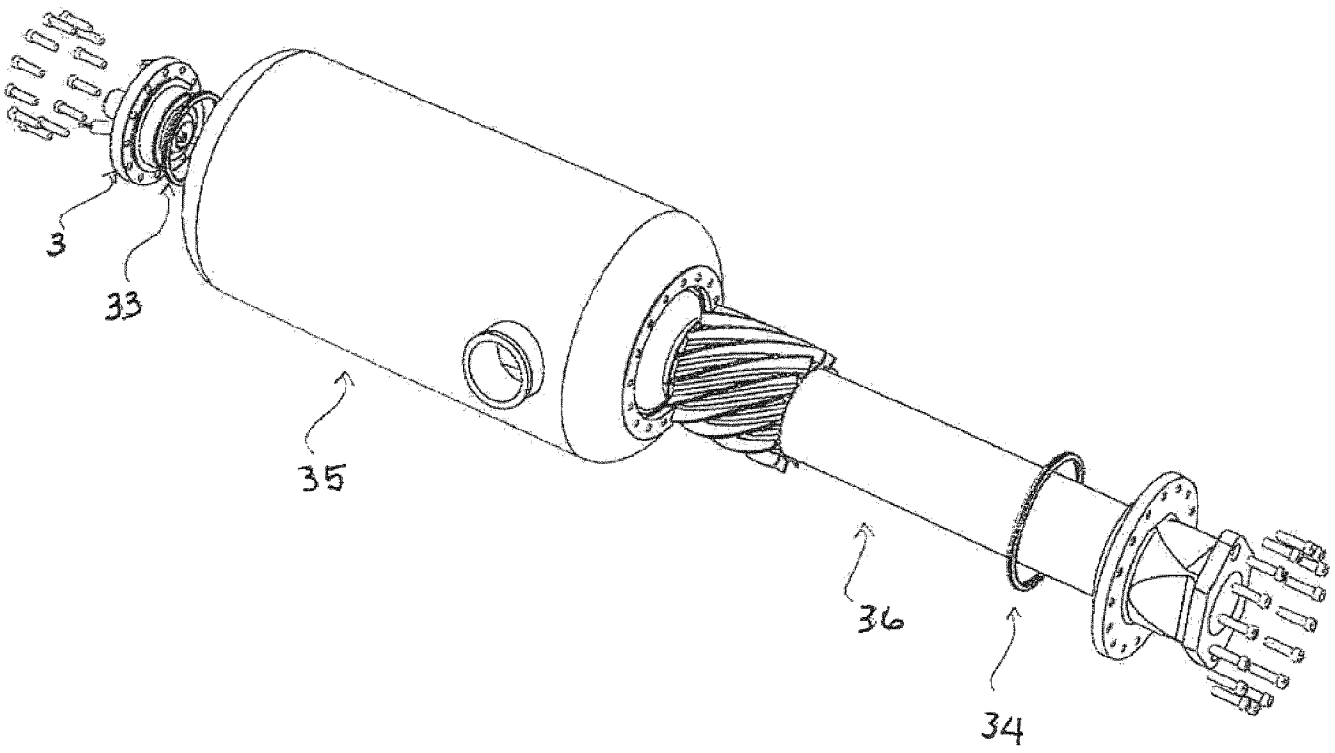
FIG. 6 is a perspective exploded view of the combustor showing certain subassembly components of the combustor, including a plenum subassembly, a combustor chamber subassembly, and the endcap subassembly.

The combustor 1 is divided into three subassemblies as shown in FIG. 6; namely an endcap subassembly 3, a plenum subassembly 35 and a combustion chamber subassembly 36, to facilitate manufacturing as well as provide access for maintenance purposes. Sealing elements 33 and 34 are metal sealing elements designed to contain positive pressure developed by the combustor.

Referring to FIG. 7, the plenum subassembly 35 is comprised of the outer shell 2, the preheat chamber shell 27, the frusto-conical deflector shell 26, the baffle plate 22, the intake port 31, the mounting flange 30 where nozzle 15 is bolted and a mounting flange 32 to which the endcap 3 is attached.

Figure 8:
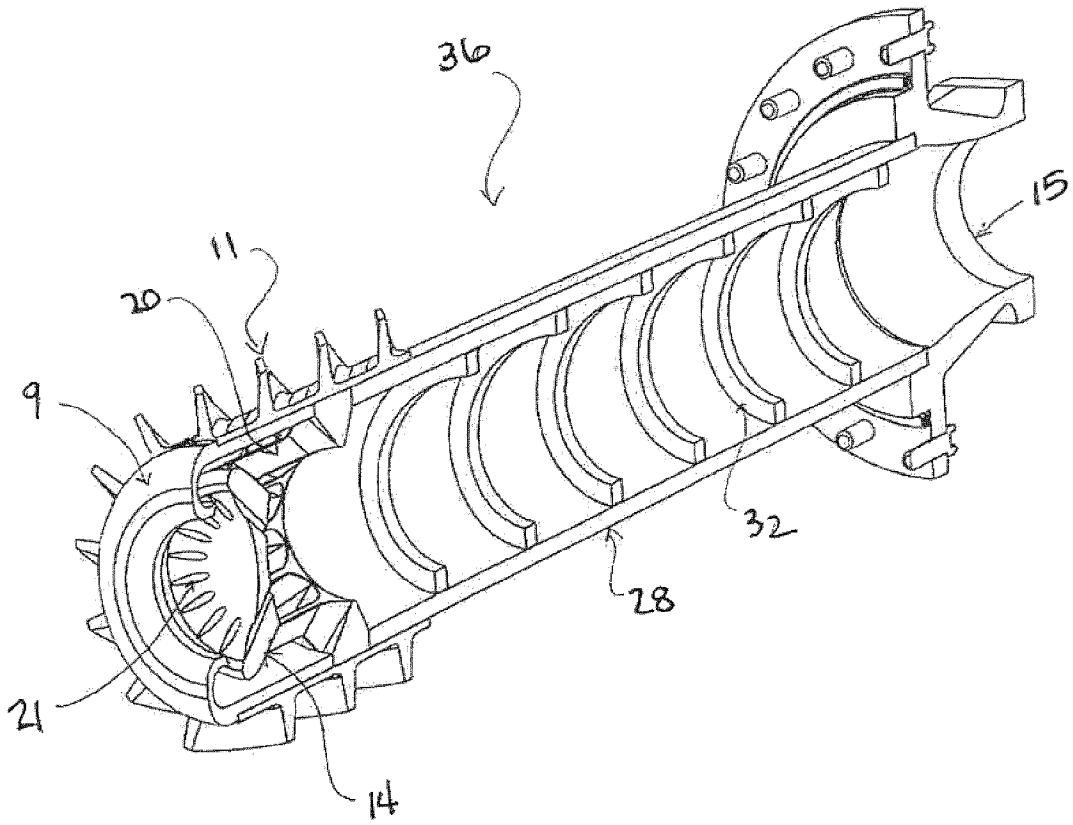
FIG. 8 a cut-away perspective view of the combustion chamber subassembly.

Referring to FIG. 8, the combustion chamber subassembly 36 comprises the detonation chamber shell 28, the nozzle 15 mounted to the front end of the detonation chamber shell 28, the swirler 11 mounted to the outside surface of the detonation chamber shell 28 near the back end thereof, a series of Shchelkin spirals 82 mounted on the inside surface of the detonation chamber shell 28, and the E-D nozzle 14 located at the back end of the detonation chamber shell 28 just inside of the nose cowling 9 and upstream of the Shchelkin spirals 82. The nose cowling 9 serves to transition the flow of oxidant radially inward into the quarl 13. The swirler 11 is slipped over the nose cowling 9 and E-D nozzle 14 and mechanically attached to detonation chamber shell 28.

The Shchelkin spirals 82 are provided along the inside surface of the detonation chamber shell 28, and can be in a helical orientation and in one form be an insert, such as a helical member inserted and fixedly attached to the detonation chamber shell 28. The distance between the rotations of the helical portion of the Shchelkin spirals can increase in frequency, or otherwise the pitch between spirals can be reduced (or in some forms increase depending on the expansion of the gas) pursuant to the operational design of the combustor.

Figure 9:
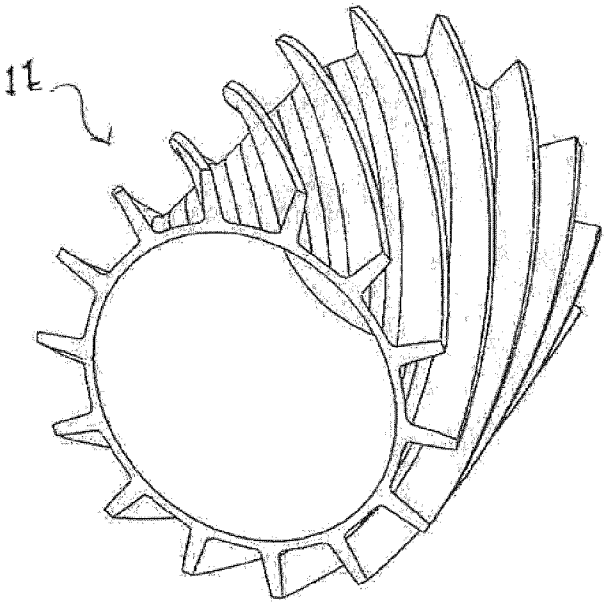
FIG. 9 is a perspective view of a swirl generator of the combustor chamber subassembly.
Figure 10:
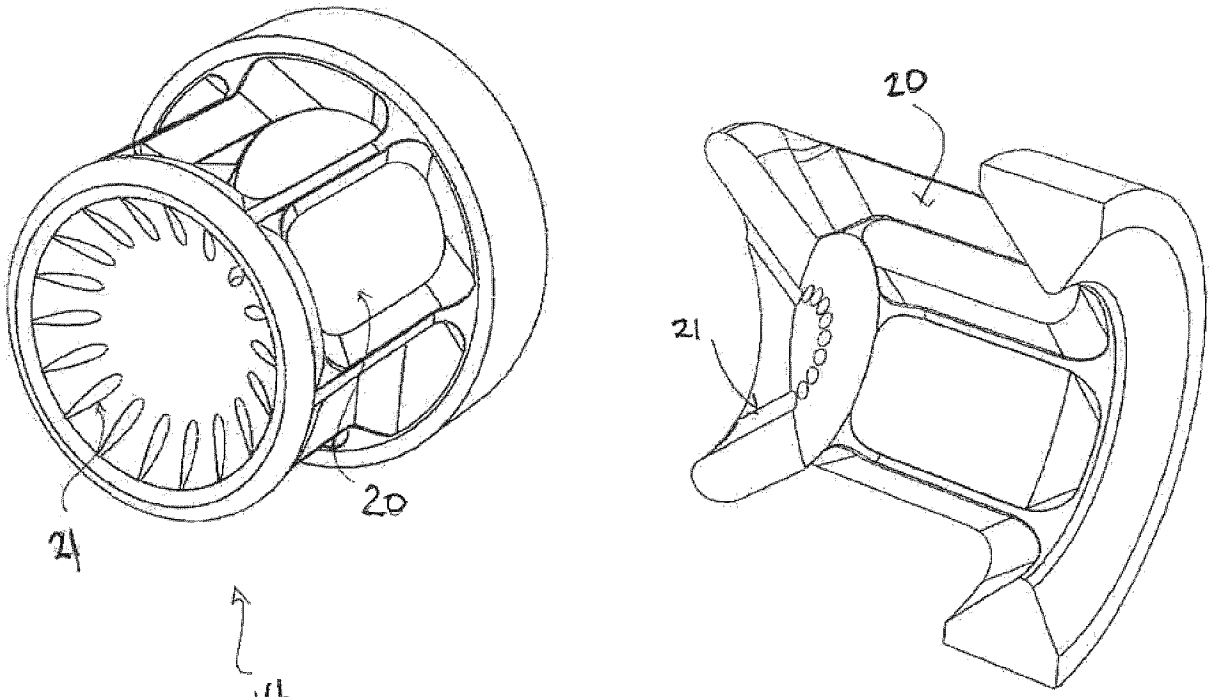
FIGS. 10(*a*) and 10(*b*) are a perspective and a cut-away view of an expansion-deflection (ED) nozzle for location inside the combustion chamber subassembly.
Figure 11:
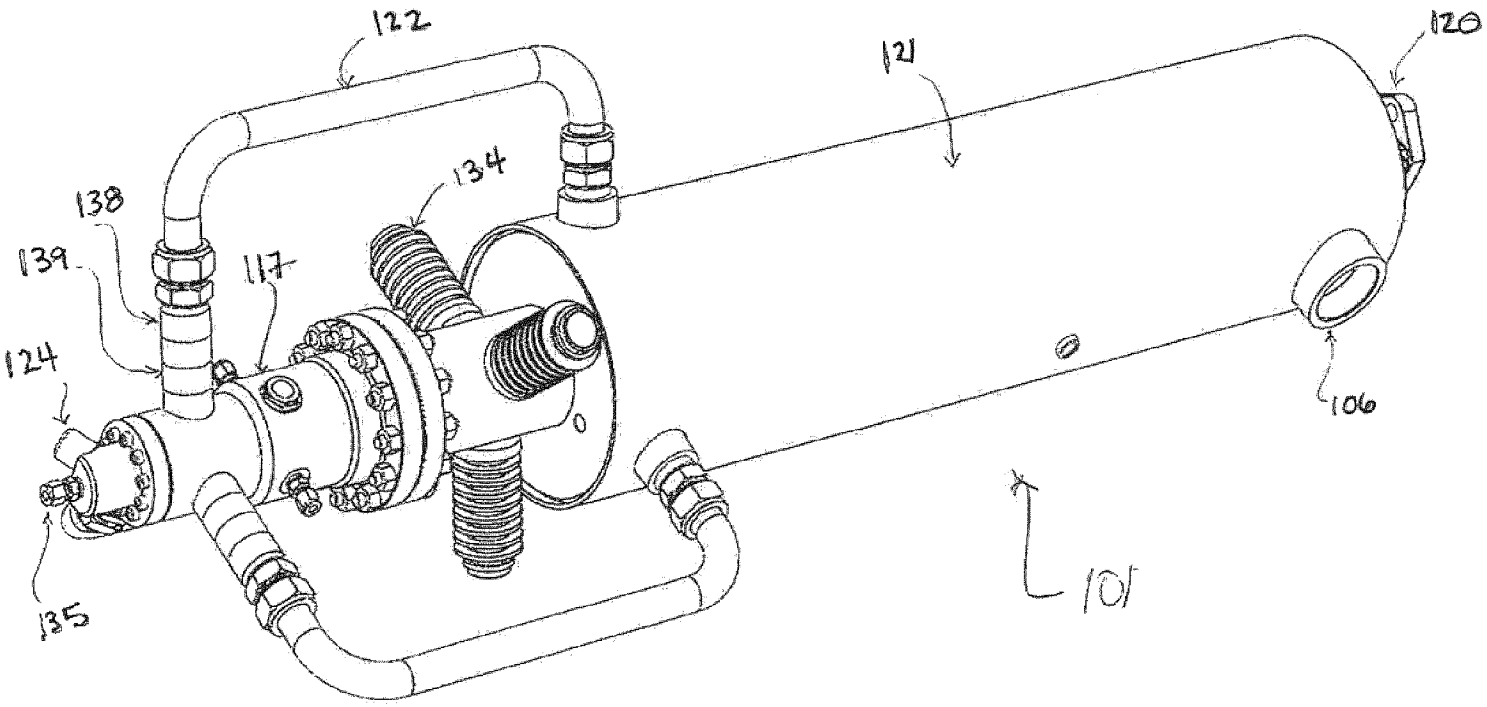
FIG. 11 is a rear perspective view of a pulse detonation combustor according to a second embodiment.

The swirler 11 is a pre-mixing swirl generator and is located in the back end of the preheat chamber 8 which leads to the opening 12 and into the quarl 13. Referring to FIG. 9, the swirler 11 is configured to generate turbulence in the oxidant flow to aid in rapidly mixing the fuel and oxidant in the quarl 13. The swirler 11 is made up of several helical vanes spaced around the circumference of a hollow tube or hub, having a twisted configuration, and the divergence of the vane surface from the axial direction increases with radius. The swirl number of the swirler 11 is dependent on determining the appropriate swirl velocities to optimize fuel and oxidizer mixing. The swirl number can be calculated using the same equation applied to straight-vane assemblies. With reference to "Combustion Aerodynamics" by J. M. Beer and N. A. Chigier, R. E. Krieger Publishing Company, 1983, the swirl number S of an axial vane swirler is given by $$S = \frac{2}{3}\left[\frac{1-\left(\frac{d_h}{d_o}\right)^2}{1-\left(\frac{d_h}{d_o}\right)^2}\right]\tan\theta$$

where;

do=outer vane diameter dh=hub or inside vane diameter

Q=deviation angle between the axial direction of the vane and the tangential direction of the vane.

A suitable number of swirls is between 0.3 to 0.6. The swirler 11 in one embodiment features a 30° deviation angle which results in a swirl number of 0.51. The swirler 11 imparts a tangential flow field of oxidant in the quarl 13. The swirler 11 is designed to produce a low pressure drop and impart sufficient turbulence to the flow to facilitate rapid fuel mixing in the quarl 13.

Turbulence has the effect of greatly enhancing fuel and oxidant mixing thereby enhancing local combustion intensity. Referring to FIG. 4, the opening 12 is cylindrically bounded by the nose cowling 9 and the inside surface of the endcap flange 32; the nose cowling 9 forms a mantle that curves inwards and backwards into the quarl 13. The presence of the nose cowling 9 further deflects the tangential flow field radially inwards due to the Coanda effect towards the centre of the quarl 13. The distributed injection of fuel into the swirling airstream generated by the Coanda effect and the swirler 11 is expected to result in rapid and effective mixing in the quarl 13.

The quarl 13 volume is defined by the inside surface of endcap 3 which defines the upstream end of the quarl, an end plate of E-D nozzle 14 which defines the downstream end of the quarl 13, and by the inside surface of preheat chamber shell 27 which defines the circumferential perimeter of the quarl 13. The intersection of the nose cowling 9 and the inside surface of the preheat chamber shell 27 defines the annular opening 12 which communicates with the annular discharge end of the preheat chamber 8. As noted above, the combination of the annular opening, the nose cowling mantle, and the swirler 11 cause oxidant flowing into the quarl to flow in a tangential turbulent manner, thereby creating an outer zone in the pre-combustion chamber that has a relatively higher fluid velocity (high swirl velocity zone) than in a central zone of the pre-combustion chamber (low swirl velocity zone). Notably, the discharge openings 41 of the fuel delivery pathway are located in the high swirl velocity zone to allow fuel to mix efficiently with the oxidant in that high swirl velocity zone, and the ignition source is located in the low swirl velocity zone to allow efficient and effective ignition of fuel-oxidant mixture in that zone.

Fuel is cyclically injected into the quarl 13 and as the oxidant flow is under high turbulence entering the quarl 13, the fuel rapidly mixes with the oxidant before entering the detonation chamber 10. The turbulent flow in the quarl 13 is channeled through ports 20 and channels 21 shaped into the E-D nozzle 14 to fill the detonation chamber 10 with the combustible mixture (see FIG. 10).

The E-D nozzle 14 serves as a diffuser to stratify the fuel/air mixture as it flows in to the detonation chamber 10. Furthermore, the E-D nozzle 14 alone and in conjunction with nose cowling 9 in this embodiment serves as a backflow suppression means which will impede backflow as well as suppress shockwaves. To achieve these purposes, the E-D nozzle 14 has a generally cylindrical body with a bore extending therethrough, and an annular rim extending outwards from the body and which contacts an outer rim of the detonation chamber shell 28, and an end plate at the upstream end of the cylindrical body. The E-D nozzle 14 is provided with multiple openings, namely circumferential ports 20 in the cylindrical body and channels 21 in the end plate; these opening permit fluid flow towards the detonation chamber 10 with relatively little resistance, but which alone and in conjunction with the nose cowling 9 shown in FIG. 4, significantly restricts backflow and suppresses detonation shock waves from traveling in the reverse direction back into the quarl 13. More particularly, the E-D nozzle body is spaced from the detonation chamber shell such that an annular space is defined and the circumferential ports 20 open into this annular space; fluid flow would thus freely flow in a downstream direction through the bore's main opening, as well as into the bore via the circumferential ports 20.

The channels 21 are aligned at an angle with the axial direction of the bore and are oriented towards the nose cowling 9 to cause reverse or backflow of non-combusted fuel and oxidant and combustion products (collectively "exhaust") from the detonation chamber 10 to interfere with exhaust backflow exiting from the openings 20 into the annular space, thus counteracting a significant portion of the back flow of exhaust from entering the quarl 13 and further restricting backflow to the preheat chamber 8. In other words, these features cause some of the exhaust back flow to change direction 180 degrees and move in the opposite direction of the rest of the exhaust back flow; this feature uses the dynamic pressure of gases to work against the back pressure and hold the exhaust back flow from moving further into the pre-heat chamber 8.

As recited above, the combustor 1, the E-D nozzle 14, the expansion chamber 7,8 and the frusto-conical deflector shell 26 each function as a stationary backflow and backpressure suppression components in the combustor 1 and act together to suppress or absorb backflow caused by backpressure from the combustion reaction. Notably, the combustor 1 does not feature mechanical inlet valving to prevent backflow. As inlet valves have shown a tendency to fail quickly in conventional pulse detonation combustors, it is expected that the stationary backflow suppression components 7, 8, 14, and 26 will be more robust and thus be more effective than inlet valves and other movable backflow suppression means.

Operation

The operation of the combustor 1 will now be discussed in respect of a single detonation cycle. The combustor 1 can generate tens or several hundred detonation cycles per second, to produce essentially a continuous power output. First, an oxidant such as air is supplied through the intake port 31, through the outer plenum chamber 7 and into the pre-heat chamber 8 where it is pre-heated by heat from previous detonations in the detonation chamber 10; the heated air then flows through annular opening 12 and into the quarl 13. During the filling stage, the preheated oxidant passes through the swirler 11 which imparts a turbulent tangential flow field as it enters the quarl 13. Fuel is then injected into the quarl 13 by the fuel injector through multiple orifices 41 in the end cap 3 directed at the high swirl velocity zone of the pre-combustion chamber. The fuel under pressure is forced through the small holes and enters the quarl 13 as an atomized spray. The atomized fuel then encounters the turbulent oxidant flow field in the quarl 13, resulting in good mixing of the fuel and oxidant. The temperature inside the quarl 13 tends to be sufficient to vaporize the fuel before a combustion event occurs, which gives the combustor multi-fuel capability.

The fuel-oxidant charge then flows through openings 20, 21 through the E-D nozzle 14 and into the detonation chamber 10. Fuel injection is continued for a selected duration specified by a control unit (not shown).

A dwell period is provided between the time that the fuel injector 24 is closed and the ignition source 25 is ignited and the combustion process is started. After the detonation chamber 10 is completely filled with the combustible fuel/oxidant mixture, the detonation sequence is initiated by the ignition source 25 which may be from an electrical spark discharge, plasma pulse or laser pulse. The process begins with ignition of the combustible fuel-oxidant mixture in the quarl 13, wherein the tangential flow field present in the quarl 13 will have its highest flow velocity along the outer regions of the chamber (where the atomized fuel is introduced) and the lowest swirl velocity at its centre. As the ignition source 25 is located in the central region of the quarl 13 where swirl velocity is relatively low, a relatively small flame kernel can be created and allowed to grow.

The ignition in the quarl 13 results in an expanding deflagration and a subsequent overpressure in the quarl 13 causes the flame front to expand and pass through the E-D nozzle 14 into the detonation chamber 10 where it ignites the remaining combustible mixture in the detonation chamber 10. The turbulent expansion of the flame front and the coalescing pressure wave as it exits the E-D nozzle 14 into the detonation chamber 10 causes quasi-detonations which initiates the detonation of the combustible mixture in the detonation chamber 10. The difference of the density of hot burned and cold unburned gas leads to an expansion flow in front of the flame. This expansion flow becomes highly turbulent as it interacts with obstacles. Turbulence generators such as the Shchelkin spirals 82 downstream of the E-D nozzle 14 cause further turbulence which consequently speed up and accelerate the flame front until it reaches the Chapman-Jouguet condition, known as the ideal detonation speed, wherein the flame front becomes attached to the shock waves as it sweeps through the remaining combustible mixture in the detonation chamber 10 and towards the discharge nozzle 15.

Large eddies tend to increase the effective flame surface, which results in an acceleration of the flame. Small scale eddies increase the heat and mass transfer in the preheating zone of the flame, which results in a thickening of the reaction zone and increasing the reaction rate.

A pre-combustion chamber such as the quarl 13 is used in this combustor 1 as a means of initially creating a highly turbulent flame which is allowed to expand into the detonation chamber via abrupt expansion or passage through a restriction like the E-D nozzle. This pre-combustion chamber creates a turbulent flame quickly, which can substantially reduce the time required for DDT compared to combustors using spark plug ignition.

Second Embodiment

Referring now to FIGS. 11 to 14 and according to a second embodiment, a pressure gain combustor 101 is operatively similar to the combustor 1 of the first embodiment by having a preheat chamber 121, and a detonation chamber 110 comprising a combustion tube 119 with a Shchelkin spiral 132 within it and a discharge nozzle 120 distal from the mixing chamber 113 and attached to the front end of the combustor 101. The nozzle 120 of the combustor 101 in this embodiment is configured to connect to a rotary positive displacement device (not shown); or alternatively but also not shown, the discharge end can be configured to produce thrust by replacing nozzle 120 with a converging-diverging nozzle (not shown).

Unlike the first embodiment, this second embodiment pressure gain combustor 101 does not feature a pre-combustion chamber 13 where fuel and oxidant are mixed and ignited, nor an E-D nozzle 14. Instead, the second embodiment features a fuel/oxidant mixing chamber 113 where the oxidant and fuel are turbulently mixed, a diffuser 114 for calming and stratifying the fuel-oxidant mixture flowing from the mixing chamber 113 into the detonation chamber 110, and an ignition source 125 that is located downstream of the diffuser 114. In other words, ignition of the fuel-oxidant mixture occurs in the detonation chamber 110, rather than in the pre-combustion chamber 10 as taught by the first embodiment. A diverging nozzle 115 interconnects the smaller diameter mixing chamber 113 with the larger diameter detonation chamber 110; the diffuser 114 is located immediately downstream of this diverging nozzle 115.

Figure 12:
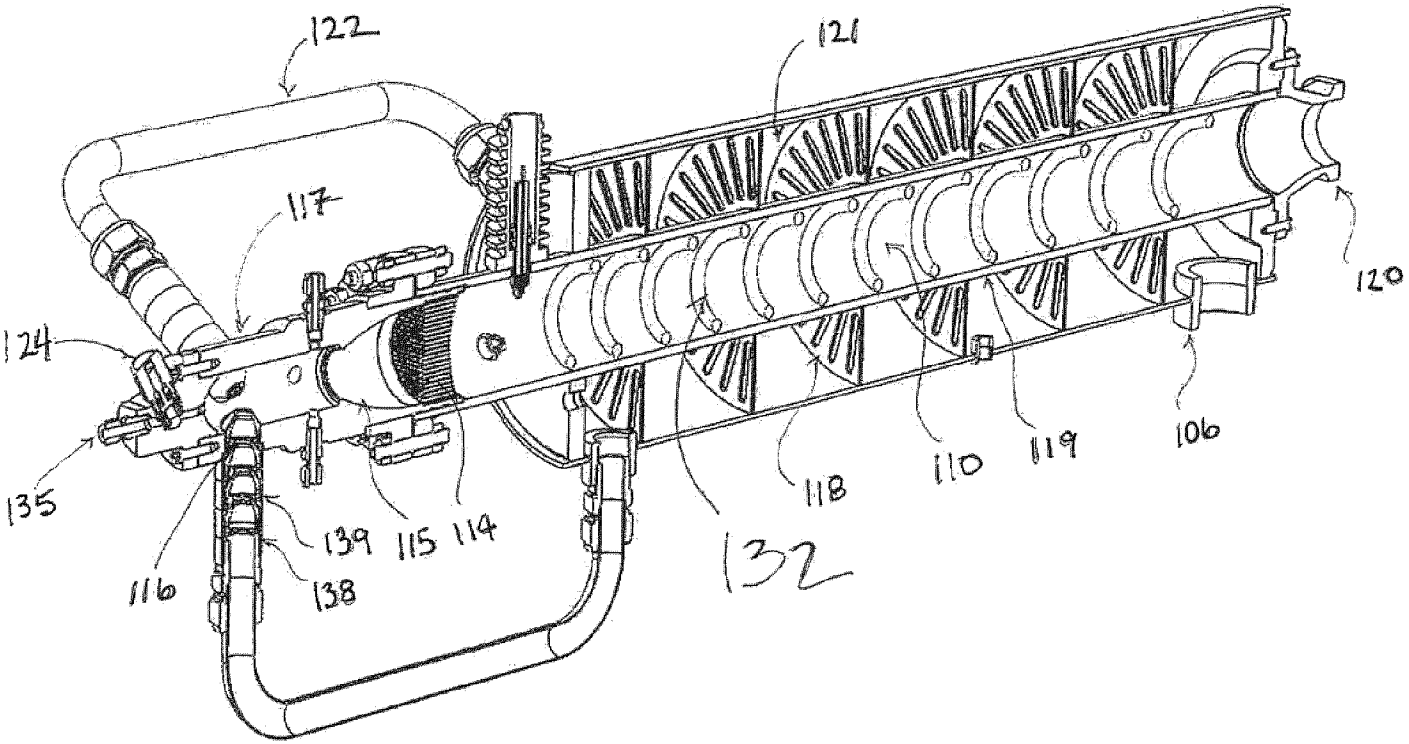
FIG. 12 is a cut-away rear perspective view of the second embodiment of the pulse detonation combustor.

With reference to FIG. 12, oxidant is fed to the mixing chamber 113 via an oxidant delivery pathway defined as beginning at an intake port 106, through a pre-heat chamber 121, through oxidant supply ducts 122, and then into the mixing chamber 113. Oxidant flow into the mixing chamber tends to be turbulent. The oxidant supply ducts 122 comprise an aerodynamic valve subassembly 139 comprising a series of aerodynamic valves which serve to suppress backflow through the oxidant delivery pathway, as will be discussed further below.

Fuel from a fuel supply port 135 is injected into the mixing chamber 113 by a fuel injector 124, and mixed with the oxidant in the mixing chamber 113 to produce a fuel-oxidant mixture. This fuel-oxidant mixture then flows through the diffuser 114 into the detonation chamber 110. The ignition source 125 initiates the deflagration of the fuel/oxidizer charge which immediately transforms to a detonation as a flame front travels forward to the front end of the combustor 101 where the exhaust is discharged through the nozzle 120.

After the charge is ignited, the deflagration is rapidly transformed to a detonation as the flame front runs up the length of the detonation chamber 110. The run-up distance (referred to as the deflagration-to-detonation-transition (DDT) zone in the detonation tube 119) occurs between the point where charge is ignited and prior to entering the exit nozzle 120. The Shchelkin spiral 132 promotes and accelerates the transition by increasing flame turbulence caused by the spiral coils along the path. Alternatively, other features such as grooves or obstacles placed along the detonation path could also be used in lieu of Shchelkin spiral 132. The length of the Shchelkin spiral 132 or obstacles placed in the DDT path should be at least 10 times the inside diameter of the detonation tube 119 and have a blockage ratio greater than 33% but less than 65% to be effective.

The ignition source 125 comprise a plurality of igniters radially mounted in the detonation chamber 110 slightly downstream of the diffuser 114. Cooling fins 134 are provided on ignition ports of the igniters to aid in dissipating heat from combustion. The igniters can be triggered simultaneously or fired sequentially in each cycle. The ignition ports are at least one half times but not more than one and one half the inside diameter of the detonation tube 119 measured from the centre of the front face of the diffuser 114 to the centre of the ignition sources 125. The igniters are configured to provide sufficient intensity to ignite the combustible mixture and may be from an electrical spark such as from an automotive spark plug or alternatively, although not shown, from a pulsed laser-induced ignition system or high energy plasma source.

The preheat chamber 121 in the second embodiment is operatively similar to the first embodiment wherein the thermal communication of the detonation tube 119 with the pre-heat chamber 121 allows heat to transfer from the detonation reaction to the oxidant flowing through the pre-heat chamber 121. The efficiency of the heat transfer is further increased by the presence of multiple baffles 118 that are evenly spaced within the preheat chamber 121; openings are provided in each baffle 118 to allow oxidizer to pass therethrough. Like the first embodiment, the pre-heat chamber 121 can also serve as an expansion chamber which has a volume selected to reduce the static pressure to a desired value, which can be less than the inlet pressure to prevent backflow out of the inlet.

Figure 13:
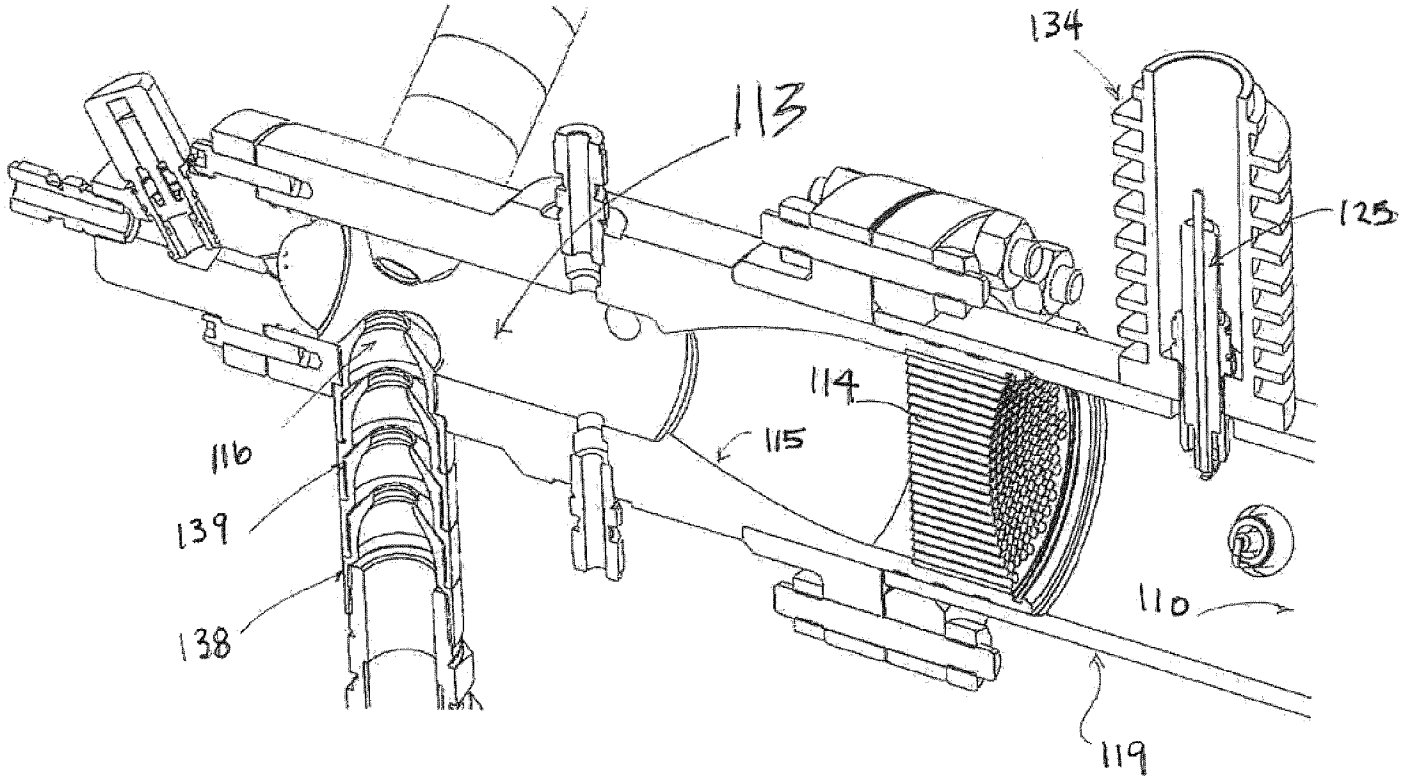
FIG. 13 is a detailed section view of a mixing chamber of the second embodiment of the combustor.

After each detonation cycle, backpressure waves are attenuated firstly by encountering backpressure suppression means like the diffuser 114 which eliminate much of the shock waves; attenuating these shockwaves also has the effect of reducing backflow. Reverse flow is further resisted by the aerodynamic valve subassembly 139 in each oxidant supply duct 122. The aerodynamic valve subassembly 139 is a stationary backflow suppression component with no moving parts. As shown in FIG. 13, the shape of the aerodynamic valve subassembly 139 is configured to impede the flow of gas travelling in the reverse direction by directing a portion of the back flow into the forward flow of oxidant.

Figure 14:
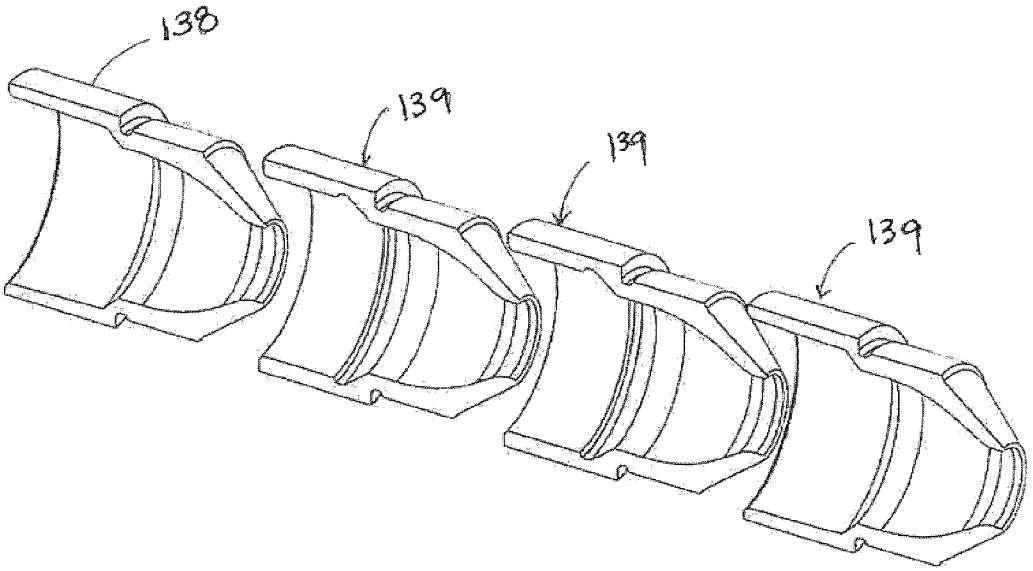
FIG. 14 is a perspective cut-away view of an aerodynamic valve of the second embodiment of the combustor.

The aerodynamic valve subassembly 139 shown in FIG. 14 is made from several parts consisting of the an attachment piece which couples the subassembly 139 to the duct 122 and multiple pieces of the annular ring segments 138 which is threaded together to form the subassembly 139 with the last segment threaded into the intake port 116 of the mixing chamber body. Each annular ring segment 138 has an internal thread on one end (proximal end) configured to match the external thread on a distal end of an adjacent ring segment 138. Each annular ring segment also has an internal bore which tapers radially inward to form a frusto-conical nozzle facing downstream. Multiple bypass holes drilled into the interior shoulder of nozzle aid in redirecting a portion of the flow back into the main stream (not shown).

Any reverse flow that makes it past the aerodynamic valve assembly 138 will then flow into the pre-heat chamber 121; if the pre-heat chamber has been configured to serve as an expansion chamber, the reverse flow will expand and the pressure drop to the desired static pressure. Like the first embodiment, the expansion chamber volume can be selected to reduce the static pressure to a desired value, which can be less than the inlet pressure to prevent backflow out of the inlet.

Optionally (but not shown), the pre-heat/plenum chamber 121 can also include a frusto-conical deflector like that found in the first embodiment. Such a deflector creates a more sinuous oxidizer pathway and thus serve to increase suppressive effect of the chamber 121 to backflow and backpressure. The baffles 118 design will be modified to mate with the deflector.

While particular embodiments have been described in the foregoing, it is to be understood that other embodiments are possible and are intended to be included herein. It will be clear to any person skilled in the art that modifications of and adjustments to the foregoing embodiments, not shown, are possible.

What is claimed is:

1. A pressure gain combustor comprising:

a detonation chamber having an upstream intake end and a downstream discharge end, the detonation chamber being configured to allow a supersonic combustion event to propagate therethrough;

a pre-combustion chamber having a downstream end in fluid communication with the detonation chamber intake end, an upstream end in communication with a fuel delivery pathway, and a circumferential perimeter between the upstream and downstream ends and having an annular opening in communication with an annular oxidant delivery pathway;

an oxidant swirl generator in the oxidant delivery pathway and comprising vanes configured to cause oxidant flowing past the vanes to flow tangentially and turbulently into the pre-combustion chamber thereby creating a high swirl velocity zone around the annular opening and a low swirl velocity zone in a central portion of the pre-combustion chamber;

an expansion-deflection (E-D) nozzle in between the pre-combustion chamber and detonation chamber and providing a diffusive fluid pathway therebetween; and an ignition source in communication with the low swirl velocity zone of the pre-combustion chamber;

wherein the E-D nozzle comprises:

a generally cylindrical body with an internal bore having a downstream end in fluid communication with the detonation chamber, an upstream end, and at least one circumferentially disposed port in the body that is in fluid communication with the bore;

an annular rim extending outwards from the body and which contacts an outer rim of the detonation chamber's intake end;

a generally cylindrical cowling that extends from the annular rim past an upstream end of the cylindrical body such that an annular space is defined between the cowl and the cylindrical body; and an end plate at the upstream end of the bore and having at least one diffuser channel extending through the plate and providing fluid communication between the bore and the pre-combustion chamber;

wherein the diffuser channel and port provide the diffusive pathway between the pre-combustion chamber and the detonation chamber.

2. A pressure gain combustor as claimed in claim 1 wherein the fuel delivery pathway has an opening sized to atomize fuel discharged into the pre-combustion chamber.

3. A pressure gain combustor as claimed in claim 2 wherein the fuel delivery pathway opening is communicative with the high swirl velocity zone of the pre-combustion chamber.

4. A pressure gain combustor as claimed in claim 1 wherein the vanes of the swirl generator are helically arranged in the annular oxidant delivery pathway.

5. A pressure gain combustor as claimed in claim 1 wherein the cowling has a mantle with a partial toroidal form and which extends into the pre-combustion chamber and into sufficient proximity with the annular opening thereof to create a Coanda effect which deflects tangentially flowing oxidant radially inwards towards the center of the pre-combustion chamber.

6. A pressure gain combustor as claimed in claim 5 wherein the end plate comprises a plurality of diffuser channels, each of which extend at an angle outwardly from the bore such that each channel is directed toward an inside surface of the cowling and not the pre-combustion chamber.

7. A pressure gain combustor as claimed in claim 6 further comprising an end cap defining the upstream end of the pre-combustion chamber, and comprising the fuel delivery pathway and an ignition port opening into a central portion of the pre-combustion chamber and in communication with the ignition source.

8. A pressure gain combustor as claimed in claim 1 wherein the ignition source is selected from the group consisting of an electrical spark discharge source, a plasma pulse source, and a laser pulse source.

9. A pressure gain combustor comprising:

a detonation chamber having an upstream intake end and a downstream discharge end, the detonation chamber being configured to allow a supersonic combustion event to propagate therethrough;

a pre-combustion chamber having a downstream end in fluid communication with the detonation chamber intake end, an upstream end in communication with a fuel delivery pathway, and a circumferential perimeter between the upstream and downstream ends and having an annular opening in communication with an annular oxidant delivery pathway;

an oxidant swirl generator in the oxidant delivery pathway and comprising vanes configured to cause oxidant flowing past the vanes to flow tangentially and turbulently into the pre-combustion chamber thereby creating a high swirl velocity zone around the annular opening and a low swirl velocity zone in a central portion of the pre-combustion chamber;

an expansion-deflection (E-D) nozzle in between the pre-combustion chamber and detonation chamber and providing a diffusive fluid pathway therebetween;

an ignition source in communication with the low swirl velocity zone of the pre-combustion chamber; and an expansion chamber in fluid communication with the oxidant delivery pathway between the pre-combustion chamber and an oxidant inlet, wherein the expansion chamber has a volume selected to reduce backpressure of back flow into the expansion chamber to a desired static pressure that is less than an oxidant pressure at the oxidant inlet.

10. A pressure gain combustor as claimed in claim 9 further comprising a pre-heat chamber thermally coupled to the detonation chamber and an oxidant plenum chamber in fluid communication with the pre-heat chamber and the oxidant inlet.

11. A pressure gain combustor as claimed in claim 10 wherein the oxidant plenum chamber comprises a frustoconical deflector shell that defines a sinuous oxidant delivery pathway inside the oxidant plenum chamber and which serves to impede backflow of combustion products and backpressure caused by detonation shockwaves.

12. A pressure gain combustor comprising:

a detonation chamber having an upstream intake end and a downstream discharge end, the detonation chamber being configured to allow a supersonic combustion event to propagate therethrough;

a pre-combustion chamber in fluid communication with the detonation chamber intake end and in fluid communication with a fuel delivery pathway and an oxidant delivery pathway;

an ignition source in communication with the pre-combustion chamber and positioned to ignite a fuel/oxidizer mixture therein; and an expansion-deflection (E-D) nozzle in between the pre-combustion chamber and detonation chamber and comprising a diffusive fluid pathway configured to be less restrictive to fluid flow in a downstream direction than in an upstream direction;

wherein the E-D nozzle comprises:

a generally cylindrical body with an internal bore having a downstream end in fluid communication with the detonation chamber, an upstream end, and at least one circumferentially disposed port in the body that is in fluid communication with the bore;

an annular rim extending outwards from the body and which contacts an outer rim of the detonation chamber's intake end;

a generally cylindrical cowling spaced from the body and which extends from the annular rim and past an upstream end of the cylindrical body and terminating with a radially and inwardly curved mantle such that an annular space is defined between the cowling and the cylindrical body; and an end plate at the upstream end of the bore and having at least one diffuser channel extending through the plate, wherein the at least one diffuser channel extends at an angle such that the channel is coupled to the bore and directed at the cowling;

wherein an upstream fluid flow is more restrictive than the downstream fluid flow due to the cowling directing at least a portion of upstream fluid flow from the channels into the annular space thereby interfering with upstream fluid flow that flows into the annular space via the port.

13. A pressure gain combustor as claimed in claim 12 wherein the mantle has a partial toroidal form and which extends into the pre-combustion chamber into sufficient proximity with the oxidant delivery pathway to create a Coanda effect which deflects tangentially flowing oxidant in an outer region of the pre-combustion chamber radially inwards towards a central region of the pre-combustion chamber.

14. A pressure gain combustor comprising:

a detonation chamber having an upstream intake end and a downstream discharge end, the detonation chamber being configured to allow a supersonic combustion event to propagate therethrough;

a pre-combustion chamber in fluid communication with the detonation chamber intake end and in fluid communication with a fuel delivery pathway and an oxidant delivery pathway;

an ignition source in communication with the pre-combustion chamber and positioned to ignite a fuel/oxidizer mixture therein;

an expansion-deflection (E-D) nozzle in between the pre-combustion chamber and detonation chamber and comprising a diffusive fluid pathway therebetween;

an expansion chamber in fluid communication with an oxidant inlet and the pre-combustion chamber, and comprising a volume selected to reduce a backpressure caused by detonation in the detonation chamber to a desired static pressure inside the expansion chamber.

15. A pressure gain combustor as claimed in claim 14 wherein the selected expansion chamber volume is a function of a selected pressure in the expansion chamber, a volume of the detonation chamber, and a detonation pressure in the detonation chamber.

16. A pressure gain combustor as claimed in claim 15 wherein the expansion chamber comprises a pressure relief valve having a pressure relief setting, and the selected pressure in the expansion chamber is the pressure relief setting.

17. A pressure gain combustor as claimed in claim 15 wherein the expansion chamber comprises a preheat chamber in thermal communication with the detonation chamber and in fluid communication with the pre-combustion chamber, and a plenum chamber in fluid communication with the preheat chamber and with the oxidant inlet.

18. A pressure gain combustor as claimed in claim 17 further comprising a deflector shell positioned inside the plenum chamber to form a sinuous oxidant flow pathway therein.

19. A pressure gain combustor as claimed in claim 18 wherein the deflector shell has frusto-conical shape.

20. A pressure gain combustor as claimed in claim 15 wherein the expansion chamber comprises a preheat chamber in thermal communication with the detonation chamber.

21. A pressure gain combustor as claimed in claim 15 wherein the expansion chamber comprises a plenum chamber in fluid communication with a preheat chamber and with the oxidant inlet.

* * * * *